United States Patent [19]

Quitoschinger

[11] 4,286,127

[45] Aug. 25, 1981

[54] PRESSURE MEDIUM ACTUATED SWITCH

[76] Inventor: Willi Quitoschinger, Maybachstrasse 6, 7120 Bissingen, Fed. Rep. of Germany

[21] Appl. No.: 69,060

[22] Filed: Aug. 23, 1979

[30] Foreign Application Priority Data

Aug. 30, 1978 [DE] Fed. Rep. of Germany ..... 2837739

[51] Int. Cl.[3] ..... H01H 35/38

[52] U.S. Cl. ..... 200/83 J; 200/83 S; 337/3

[58] Field of Search ..... 337/3; 200/81 R, 82 R, 200/82 C, 83 R, 83 A, 83 J, 83 SA, 83 C, 83 S, 153 L, 153 LA, 153 T, 153 SC, 335

[56] References Cited

U.S. PATENT DOCUMENTS 3,414,710 12/1968 Mertler ..... 337/3
4,082,929 4/1978 Thorsen ..... 200/81 R
4,180,714 12/1979 Hansen ..... 200/83 S

FOREIGN PATENT DOCUMENTS 1940338 12/1970 Fed. Rep. of Germany .

*Primary Examiner*—Gerald P. Tolin
*Attorney, Agent, or Firm*—Craig and Antonelli

[57] ABSTRACT

A push switch construction with an adjustable switching point which includes a piston or membrane adapted to be pressurized by a pressure medium and to actuate a switching element against an action of a restoring spring when a predetermined switching point is reached. The piston or membrane is operationally linked with a pivotably mounted switch lever which is adapted to actuate the switching element. The switch lever is tensioned by a leaf spring through a counter bearing displaced lengthwise relative to the switch lever in a direction opposite to a torque exerted by the piston or membrane.

34 Claims, 13 Drawing Figures

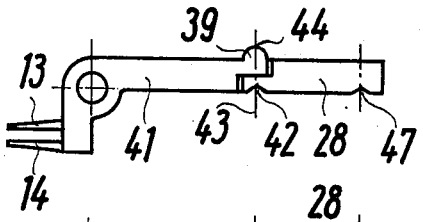
Fig. 6
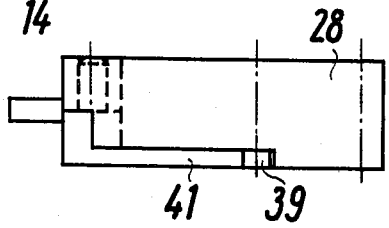
Fig. 7
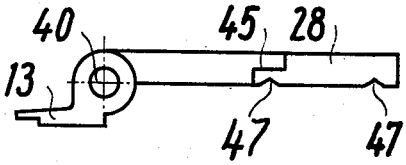
Fig. 8
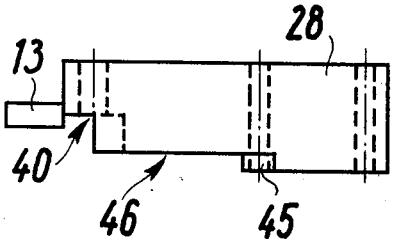
Fig. 9
Fig. 10
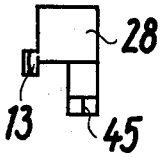
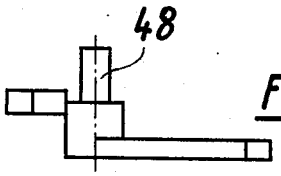
Fig. 12
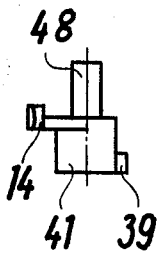
Fig. 13
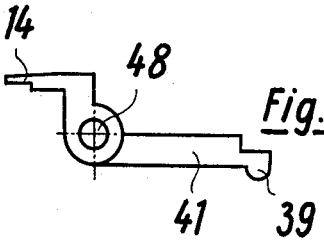
Fig. 11

PRESSURE MEDIUM ACTUATED SWITCH

The present invention relates to a switch arrangement and, more particularly, to a pressure medium actuated switch with an adjustable switching point which includes a piston or membrane which is tensioned by a pressure means and adapted to actuate the switching element against the action of a restoring spring when a certain switching point is reached.

Pressure medium actuated switches of the aforementioned type have been proposed in, for example, German Pat. No. 1,940,338 wherein a membrane, reinforced by a mushroom-shaped element, acts against piston member that is oppositely biased by a coil compression spring, which spring is mounted in a guide element that is displaceable from the outside by way of a screw. By virtue of such a construction, the pretensioning of the coil compression spring and the switching point of the push switch can be adjusted.

A disadvantage of the switch of the aforementioned type resides in the fact that the use of coil compression springs has been found to be too inaccurate for certain applications. More particularly, when a change occurs in the adjustment of a switching point as a result of the spring characteristic of the coil compression springs, due to a changing pretensioning of the coil compression spring, other circumstances arise which do not always permit switching to take place accurately at certain pressure values.

Additionally, the spring characteristics of the coil compression springs, constantly under pretension, also change with time.

The aim underlying the present invention essentially resides in providing a pressure medium actuated switch with an adjustable switching point which is constructed in such a manner that the switch operates more accurately and avoids the aging phenomena of the restoring spring.

In accordance with advantageous features of the present invention, the piston or membrane is operationally linked to a pivotally mounted switching lever which is adapted to actuate the switching element and which is tensioned by a leaf spring through a counter bearing displaceable in a lengthwise or longitudinal direction of the lever opposite to a torque produced by the piston or membrane.

By virtue of the above noted features of the present invention, an adjustment of the switching point is permitted by changing the moment operating in the opposite direction instead of by changing the opposing force. Moreover, the use of a coil spring can be avoided and it is also possible, in accordance with the present invention, to select a construction such that the leaf spring is completely unstressed in the original position. This construction has the advantage that the restoring forces are only applied when pressure is applied and then by a leaf spring whose spring characteristic is much more precise than that of a coil compression spring. Consequently, the switch construction of the present invention operates more realiably and precisely.

It is also advantageously possible in accordance with the switch construction of the present invention to equip the switch with both a connectable switching point and an adjustable switch-back differential. Heretofore this has only been possible by using two switches of the construction such as proposed in the aforementioned German Patent, whereby one switch triggers a switch when a certain upper pressure is reached and the other switch triggers a second switch when the pressure falls to a certain lower level.

By virtue of the last mentioned features of the present invention, it is possible to provide a switch with an adjustable switch-back differential with one element and using only one pressurized piston or membrane as well as only one leaf spring. If a second lever is mounted on the switch lever outside of the pivot axis of the switching lever with a counter bearing associated with the second lever, the counter bearing coincides as closely as possible to the pivot axis of the switch lever and is capable of contacting a contact surface whose difference from the counter bearing is adjustable. In this manner, the second lever is entrained by the restoring movement of the switch lever only when the counter bearing has come into contact with the stop so that a bistable switch is provided as the switching element. This construction makes it possible to be able to adjust both switching points exactly without necessitating an additional expense for a second switch to be driven with the necessary torsion. The bistable switch is turned on by the switch lever when the first switching point is reached and remains in such position until it is switched back again by the entrainment of the second lever.

A structurally advantageous construction in accordance with the present invention is achieved when the switch lever is designed as a double-armed lever with one of the lever arms being engaged by the piston or the membrane and the other of the lever arms having the second lever mounted thereon. The distribution over a double-armed lever makes it possible to dispose the counter bearing for the switch lever and for the second lever to one side thereby permitting a compact and economical overall design. Therefore, the counter bearing for such switching lever can advantageously be mounted at the end of the leaf spring with the spring being displaceably mounted itself. Such a construction makes the switching points no longer dependent upon the pretensioning of a spring but exclusively dependent upon the lever ratio which is advantageous in that, on the one hand, the leaf spring is unstressed in the original position and, on the other hand, the spring is not subjected to significantly more stress at the higher pressure values to be reached than it is at smaller pressure values. Thus, the spring continuously operates in the same area of its spring characteristic and permits a very accurate functioning of the switch.

A structurally simple construction can be realized by mounting the leaf spring on a guide strip which is guided laterally in a housing and is adjustable by a slide. The slide is accessible from the outside of the housing and is adapted to be fixed to the housing in a conventional manner such as, for example, a grub screw, when the desired switch position has been set.

In order that it is possible to replace one leaf spring by another if, for example, the pressure range of the switch is to be modified, according to a further feature of the present invention, the leaf spring can be interchangeably mounted on the guide strip.

Advantageously, the support surface for the counter bearing for the second lever may be formed by a guide strip which is capable of being provided with a support surface directed toward the lever. This latter support surface may be curved so that, by changing the distance to the counter bearing and the line of contact with the second lever, the degree of displacement can be changed. Such an arrangement makes it possible to provide a scale on the externally operable slide which scale is adjustable to specific conditions.

It has been found however that a sloping plane is the simplest construction for such a support surface so that by displacing the sloping plane, the space between the counter bearing of the second lever and the guide strip may be changed in a very simple manner thereby making the switch-back differential adjustable in different ways.

The guide strip for the leaf spring and guide strip with the counter bearing for the second lever are, in accordance with the present invention, advantageously mounted parallel to one another in the housing in corresponding guides and they may be located in immediate contact with one another and forced together with a zero play by a leaf spring disposed laterally in the housing as well as be pressed against the housing guide as well. In this manner, even if the grub screws on the slides are loosened for adjustment, the adjustment will be smooth and reliable.

For spatial reasons, it is advantageous for the second lever to be disposed in recesses in the switch lever so that the two abutting levers require no more space than a pivot lever. The second lever, with a bearing pin mounted laterally thereon, may engage in a hole of the switch lever so that special bearing or mounting devices need not be provided.

Advantageously, according to the present invention, the switch lever is tensioned by a piston, which piston engages the switch lever by a prismatic edge. Such an arrangement can be constructed so that the pivot bearing for the switch lever is, like the piston, provided with an edge whereby the pivot bearing and piston can be made as similar parts and a membrane or sealing sleeve may be associated with the pressurized piston. Such a construction also makes it possible to make the pivot bearing and the piston both capable of being subjected to the action of pressure or vacuum so that the switching processes may be triggered thereby.

The counter bearing of the present invention may be constructed as a projection which is adapted to come into linear contact with the support surface with the contact line being disposed in a plane which runs vertically through the pivot axis of the switch lever and vertically through a longitudinal axis of the switch lever at the smallest possible distance from the pivot axis.

Moreover, the prismatic or knife edge which forms the pivot bearing for the switch lever and the prismatic or knife edge 31 which tensions the switching lever by means of a stepped cylindrical insert, are constructed identically including the corresponding inserts with the insert tensioned by the pressure medium being additionally provided with a sealing sleeve or the like.

The leaf spring of the present invention may be in the form of a bimetallic spring and the guide strip provided with the sloping surface may be constructed so as to serve as a stop for the maximum extension of the leaf spring.

Accordingly, it is an object of the present invention to provide a push switch construction which avoids, by simple means, shortcomings and disadvantages encountered in the prior art.

Another object of the present invention resides in providing a push switch construction having an adjustable switching point which operates precisely and realiably.

Yet another object of the present invention resides in providing a push switch construction with an adjustable switch-back differential.

A still further object of the present invention resides in providing a push switch construction with an adjustable switching point wherein the switching point is no longer dependent upon a pretensioning of a spring but exclusively dependent upon a ratio of the switch lever.

Another object of the present invention resides in providing a push switch with an adjustable switching point which is simple in construction and therefore relatively inexpensive to manufacture.

Yet another object of the present invention resides in providing a push switch construction which functions realiably under all operating conditions.

These and other objects, features, and advantages of the present invention will become more apparent from the following description when in taken in connection with the accompanying drawings which show, for the purposes of illustration only, one embodiment in accordance with the present invention, and wherein:

FIG. 6 is a side view of the lever mechanism of the push switch construction of the present invention;

FIG. 7 is a top view of the lever mechanism of FIG. 6;

FIG. 8 is a side view of a switch lever of the lever mechanism of FIG. 6;

FIG. 9 is a top view of the switch lever of FIG. 8;

FIG. 10 is an end view of the switch lever of FIG. 8;

FIG. 11 is a side view of a second lever of the lever mechanism of FIG. 6 mounted on the switch lever and rotated through 180° relative to FIG. 8;

FIG. 12 is a top view of the lever of FIG. 11; and

FIG. 13 is an end view of the lever of FIG. 11.

Figure 2:
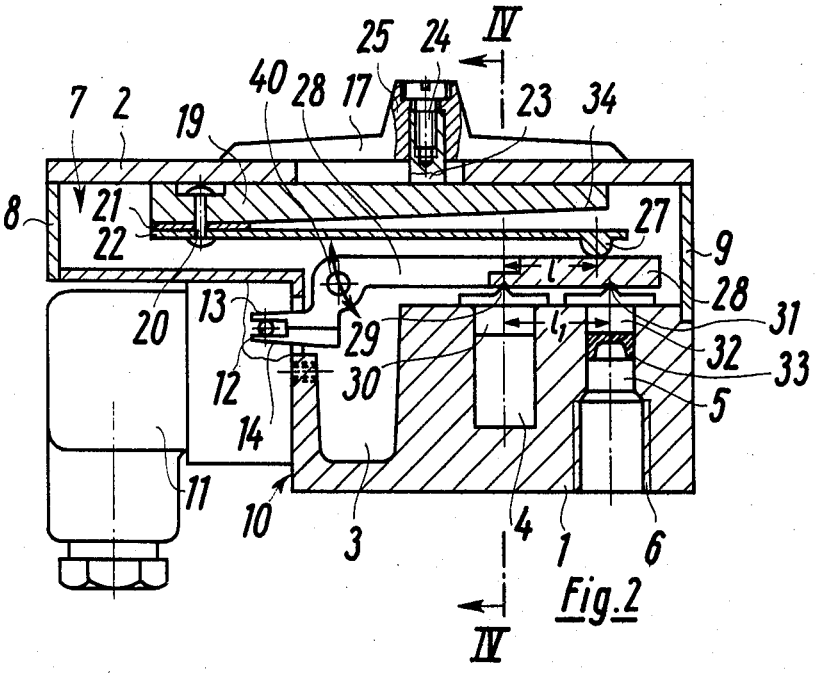
FIG. 2 is a cross-sectional view taken along the line II—II in FIG. 1.

Referring now to the drawings wherein like reference numerals are used throughout the various view to designate like parts and, more particularly, to FIGS. 1–5, according to these figures, a housing 1 for a pressure medium actuated switch with an adjustable switch-back differential has parallel side and end walls and is covered by a cover plate 2. The housing 1 essentially consists of a rectangular basic unit provided with a recess 3 and two holes 4, 5 with the hole 4 being a blind hole and the hole 5 being provided with a terminal part which is expanded and provided with a connecting thread 6.

The housing 1, at a top portion thereof, makes a transistion to a groove 7 which is open at the top and which has an approximately rectangular cross-sectional configuration. The groove 7 is covered at both ends by cover plates 8, 9. The adjustable parts essential for the function of the switch being disposed in the space of the inside groove 7 and immediately adjacent thereto.

A conventional switch 11 is disposed in a space below the groove 7 at an end generally designated by the reference numeral 10 of the housing 1. The conventional switch 11 is constructed as a bistable switch having an extension spring 12 which is stretched between two switch tabs 13 and 14 having an arrangement relative to the switch parts which will be described more fully hereinbelow.

The cover plate 2 is provided with two grooves adapted to accept two scales generally designated by the reference numerals 15, 16 with the scales 15, 16 being adapted to respectively be partially covered by slides 17, 18. As shown in FIG. 2, the slide 17 is connected with a guide strip 19 with a leaf spring 22 being attached to the guide strip 19 by way of a hollow rivet or the like. A spacer 21 is inserted between the leaf spring and the guide strip 19.

The leaf spring 22 is interchangeable and, it is possible to provide a leaf spring which has a thickness which corresponds to the thickness of the spacer 21 and leaf spring 22 thereby eliminating the need for a spacer. The guide strip 19 is provided with a threaded stub 23 which is adapted to threadably receive a grub screw 24 which passes through a base 25 on the slide 17. When the grub screw 24 is tightened, the position of the guide strip 19 is ensured by virtue of the fact that it abuts the underside of the cover plate 2. When the grub screw 24 is loosened, the slide 17 together with the guide strip 19 can be displaced parallel to side edges generally designated by the reference numeral 26 (FIG. 1) of the housing 1.

A counter bearing 27 having an approximately half-round or semi-circular profile is mounted at a free end of the leaf spring 22. The counter bearing 27 includes, for example, a profile section glued or otherwise secured to the leaf spring 22. In the position shown in FIG. 2, a counter bearing abuts an upper surface of a switch lever 28. The switch lever 28 is pivotably mounted in the housing 1 on a knife edge 29 of a stepped cylindrical shaped insert 30. A left lever arm of the switch lever 28 extends to the actuating tab 13 while the right lever arm rests upon an additional knife edge 31 of another stepped cylindrical shaped insert 32. The insert 32 is provided at the bottom with a sealing sleeve 33 and rests in the hole 5.

When a corresponding pressure connection is threadably inserted into the thread 6 of the hole 5 is pressured by a pressure medium, the insert 32 pushes the switch lever 28 upward by means of the knife edge 31. The switch lever 28 then pivots or swivels counterclockwise around the knife edge 29 so that the switch tab 13 forces the extension spring 12 of the bistable switch 11 downward thereby triggering a switching process.

The switching point at which the switching process is triggered is determined by the position of the counter bearing 27 which exerts a torque operating clockwise on the right lever arm, as viewed from the knife edge 29, as a result of the spring force of the leaf spring 22 when the leaf spring 22 is forced in a direction of a sloping surface 34 of the guide strip 19. The position of the counter bearing 27 is also changed by sliding the guide strip 19 so that the length l of the lever arm of the switch lever 28 located to the right of the knife edge 29 is also changed. Therefore, the switching point of the push switch of the present invention is not adjusted by changing the force of the leaf spring 22 but exclusively by changing the effect of the lever arm having the length l through which the force of the leaf spring 22 operates in a direction opposite to the torque which acts, by way of the piston-shaped insert 32, depending on the pressure of the pressure medium on the switch lever 28 by way of a lever arm having a length $l_1$. Consequently, in this construction, the leaf spring 22 remains completely unstressed in the original position shown in FIG. 2 and exerts a counterforce on the switch lever 28 only when the switch lever 28 is swiveled or pivoted counterclockwise.

Figure 1:
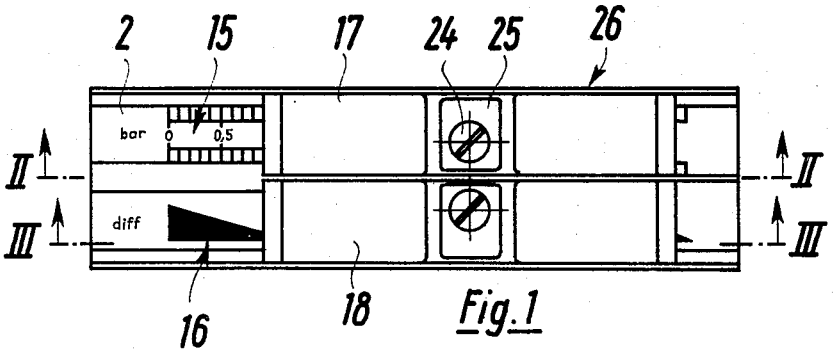
FIG. 1 is a top view of a push switch with an adjustable switch back differential in accordance with the present invention.
Figure 4:
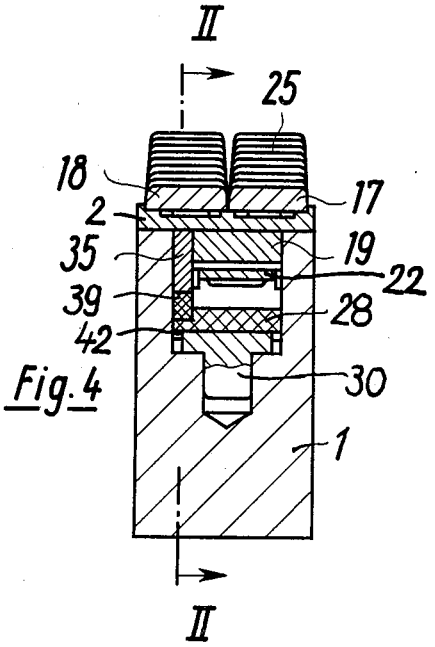
FIG. 4 is a cross-sectional view taken along the line IV—IV in FIG. 3.
Figure 5:
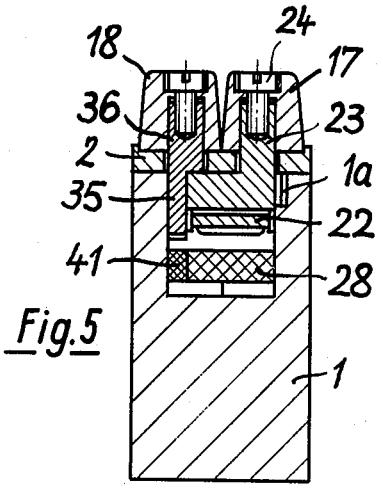
FIG. 5 is a cross-sectional view taken along the line V—V in FIG. 3.

As shown most clearly in the details of FIGS. 1, 4, and 5, the slide 18 is provided with a guide strip 35 with the slide 18 being disposed in the housing 1 adjacent the slide 17 and guide strip 19. The guide strip 35 is connected with the slide 18 by a pin-like projection 36 which is provided with an internal thread for receiving, for example, a grub screw 34. The guide strip 35 is constructed so as to be much narrower than the guide strip 19 and abuts the guide strip 19. A leaf spring 1*a* (FIG. 5) is disposed laterally in the housing 1 with the spring ensuring a zero-play guidance of the two guide strips 19, 35 in the housing 1.

The guide strip 35 includes a plate having a lower surface 37 which is disposed in a plane inclined at a small angle relative to a plane in which the upper lateral surface 38 of the guide strip is disposed. The lateral surface 38 abuts a lower edge of the cover plate 2 in the same manner as the upper edge of the guide strip 19 of the slide 17 located parallel thereto. In this manner, as in the case of the slide 17, it is possible by loosening the grub screw 24 to slide the guide strip 35 inside the groove or depression 7 so that, for example, it is possible to reach the position illustrated in phantom lines in FIG. 3.

Figure 3:
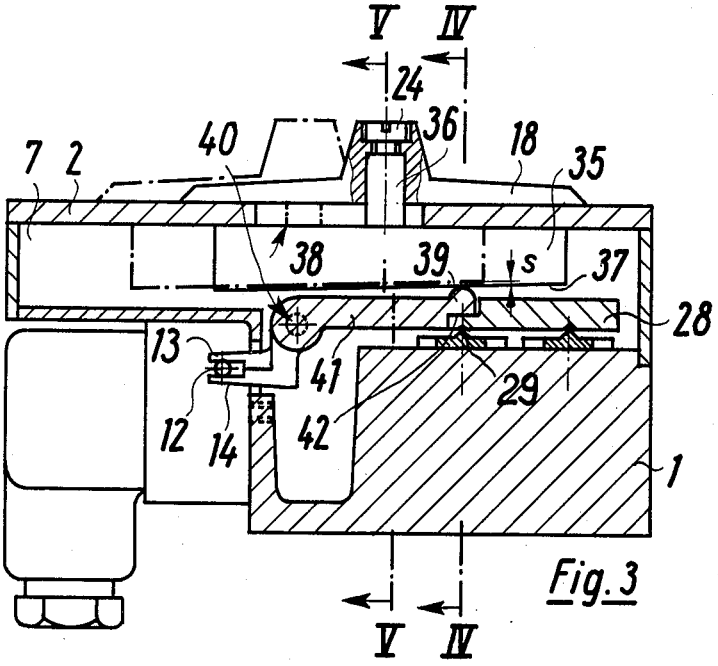
FIG. 3 is a cross-sectional view taken along the line III—III in FIG. 1.

In the position illustrated in phantom lines in FIG. 3, the contact surface 37 of the guide strip 35 is at a distance s from projection 39 which is formed with an approximately half-round or semi-circular cross sectional configuration. The projection 39 is located on a right hand free end of a second lever 41 which is pivotably mounted in a hole generally designated by the reference numeral 40 of the switch lever 28. The second lever 41, to the left of the pivot axis which corresponds to a center axis of the hole 40, is formed as an actuating or switch tab 14. Depending upon the position of the guide strip 35 and the resultant space s, the switchback differential can be set to various values.

The setting to various values is accomplished as outlined hereinabove.

More particularly, the switch lever 28 is pivoted in a counterclockwise direction around the knife edge 29 by the pressure medium acting upon the piston-shaped insert 32 whereby the switch lever 28 entrains the second lever 41 so as to pivot the same in the same direction by means of a surface 42 which serves as a stop for the second lever 41 as also shown in FIGS. 6–13. Therefore, the switch tab 13 presses the extension spring 12 of the bistable switch 11 downwardly and triggers the switching procedure as a function of the adjusted switching point or, in other words, as a function of the position of the counter bearing 27.

It is therefore important that a zenith of the semi-circular profile shaped counter bearing 39 or, in other words, the contact line 44 between the counter bearing 39 and support surface 37 be located exactly above the knife edge 29 which forms the pivot axis for the switch lever 28. The construction causes no significant displacement of the contact line 44 between the counter bearing 39 and support surface 37 when the switch lever 28, under the influence of the pressure medium acting upon the insert 32, is pivoted counterclockwise. Regardless of whether or not a distance or space s is adjusted by displacement of the guide strip 35, the switch tab 13 of the switch lever 28 will force the extension spring 12 downwardly and trigger the switching procedure in the manner outlined hereinabove as a function of the position of the leaf spring 22.

If the pressure medium drops, the insert 32 will be displaced downwardly and, consequently, the switch lever 28 moves in a clockwise direction as a result of the restoring force of the leaf spring 22. The switch tab 14 of the second lever 41 will initially be restrained by the holding force of the extension spring 12 of the bistable switch 11 and a fork, formed by the switch tabs or tongues 13 and 14, can be open depending upon whether or not a distance or space s has been provided between the supporting surface 37 and counter bearing 39. If no distance of space s has been provided, the fork formed by the switch tabs 13 or 14 will not open and the extension spring 12 of the bistable switch will not be moved back during the course of return movement of the switch lever 28. The second lever will be thereby subjected to a torque acting clockwise such that it comes to rest with its counter bearing against the guide strip 35 and its associated pivot bearing in the hole 40 will be pivoted upward about the knife edge 29.

If a distance or space s has been provided, the return pivoting movement of the lever 41 will only occur when the counter bearing 39, under the reverse pivoting action of the switch lever 28 and the resultant pivoting movement of the pivot bearing of the lever 41 in the hole 40 upward will come to rest against the support surface 37. It is only at this point that the switch tab 14 will be forced upward so that the bistable switch 11 can be thrown. Thus, the provision of an adjusting distance or space s permits the switch-back differential to be adjusted.

FIGS. 6–13 provide details of the constructional features of the switch lever 28 and second lever 41.

As shown in FIGS. 6 and 7, the switch lever 28 is provided with a prismatic recess 42 on an underside thereof which is engaged by the knife edge 29 so as to form a pivot axis for the switching lever 28. The zenith of the counter bearing 39, constructed as a projection, lies in a plane 43 which is at right angles to a lengthwise axis of the switch lever 28. As noted above, the counter bearing 39 comes to rest against a guide surface 37 forming the contact line 44.

The fact that the contact line 44 is located above the pivot bearing or knife edge 29 of the switch lever 28 and scarcely changes its position with a minimal pivoting movement of the switching lever 28 allows the principle of abutting guide surfaces to be implemented. The switch lever 28 must be made of a material which is not an electrical conductor when the extension spring of the switch 11, for example, a microswitch, is an electrical conductor, as is the case in conventional constructions. The bistable switch 11 is mounted on the wall 10 of the housing so as to be adjustable relative to the fork formed by the switching or actuating tabs 13, 14.

Additionally, as shown more clearly in FIGs. 8–10, the switch lever 28 is provided with a recess 45 upon which that part of the second lever 41 provided with the counter bearing 39 rests. However, in an area of the recess 45, an additional lateral recess generally designated by the reference numeral 46 begins into which lateral recess the entire second lever 41 is inserted. The second lever is then mounted on a switch lever by means of a bearing pin 48 (FIG. 12) which is adapted to be inserted into the hole 40. The switch lever 28 also includes a second notch 47 which accommodates the knife edge 31. The switch lever 28 has its greatest width and thickness in a vicinity of notches 47; however, both levers 28 and 41 together take up no more space than need be provided if switch lever 28 were given its greatest width and thickness throughout its length.

In addition to the push switch construction of the present invention being very compact and simple, it is also constructed to be resistant to excess pressure because the leaf spring 22 can abut the sloping surface 34 of the guide strip 19 so that the permissible bending stress on the leaf spring 22 will not be exceeded. Moreover, the operation of the switch construction can be much more precise than conventional switches with or without a switch back differential and the switch back differential may be adjusted over the entire pressure range. Moreover, the switch back differential may be very small because the prism or knife edge bearing of the switch lever 28 creates little friction and only the restoring force of the bistable switch 11 and friction of the sleeve of the insert 32 formed, for example, as a piston, tensioned by sealing sleeve 33 or an equivalent membrane is effective. The use of such a membrane is known, from German Pat. No. 1,940,338, as indicated above, and this German patent is hereby incorporated by reference with respect to said membrane usage.

Additionally, it is also possible in accordance with the present invention to construct a leaf spring of a bimetallic material so that a temperature-dependent switching process can be achieved as well.

While I have shown and described only one embodiment in accordance with the present invention, it is understood that the same is not limited thereto but is susceptible of numerous changes and modifications as known to one having ordinary skill in the art, and I therefore do not wish to be limited to the details shown and described herein, but intend to cover all such modifications as are encompassed by the scope of the appended claims.

I claim:

1. A pressure medium actuated switch for operating a switch element, the switch including actuating means adapted to be acted upon by a pressure medium and actuating a switch element upon reaching a predetermined switching point, characterized in that the actuating means includes a first lever means operatively connected with the switching element, means pivotally mounting the first lever means for movement about a pivot axis extending transversely with respect to a longitudinal axis of said first lever means, an operating element operatively connected with said first lever means and applying a first force thereto, a leaf spring means applying a second force to said first lever means that acts in a direction opposing said first force when it moves, counter bearing means mounted so as to be displaceable by the leaf spring means and transmitting said second force to said first lever means, and moveable means displaceably mounting said leaf spring means and said counter bearing means so as to be displaceable longitudinally of the first lever means toward and away from said pivot axis and so as to alter the magnitude of a torque produced by said second force relative to an opposite torque produced by said first force.

2. A switch according to claim 1, characterized in that a second lever means is provided, pivot bearing means are provided which pivotally mount the second lever means on the first lever means, said pivot bearing means being spaced from the pivot axis of the first lever means, a further counter bearing means is associated with the second lever means, said further counter bearing means being arranged so as to substanially coincide with the pivot axis of the first lever means, a support surface means adapted to be abutted by the further counter bearing means, said support surface means being arranged at an adjustable distance from the further counter bearing means in such a manner that the second lever means is entrained by a restoring movement of the first lever means only when the further counter bearing means abuts the support surface means.

3. A switch according to claim 2, characterized in that the further counter bearing means is formed as a projection adapted to come into linear contact with the supporting surface means, and in that the line of contact is disposed in a plane which extends vertically through the pivot axis of the first lever means and vertically through the longitudinal axis of the first lever means at the smallest possible distance from the pivot axis of said first lever means.

4. A switch according to claim 3, characterized in that the first lever means is constructed as a double-armed lever with a first lever arm being engageable with the operating element and a second lever arm at which the second lever means is pivotally mounted.

5. A switch according to claim 4, characterized in that the counter bearing means associated with the leaf spring means is mounted on a free end of the leaf spring means.

6. A switch according to claim 5, characterized in that said mounting means includes a guide strip means laterally guided in a housing of the switch, and a slide means is provided for adjusting the position of the guide strip means.

7. A switch according to claim 6, characterized in that means are provided for adjustably positioning the slide means relative to the housing of the switch.

8. A switch according to one of claims 5, 6, or 7, characterized in that the leaf spring means is interchangeably mounted on the guide strip means.

9. A switch according to claim 8, characterized in that a further guide strip means is laterally guided in the housing of the switch, and in that said supporting surface means is provided on said further guide strip means.

10. A switch according to claim 9, characterized in that a cover plate is arranged over an upper edge of said further guide strip means, and in that the supporting surface means is inclined at a slight angle with respect to a plane extending through an upper edge of said further guide strip means and coinciding with a lower edge of the cover plate.

11. A switch according to claim 10, characterized in that the further guide strip means is displaceable in parallel to the first mentioned guide strip means, and in that a further slide means is provided for adjusting a position of the further guide strip means.

12. A switch according to claim 11, characterized in that further leaf spring means are laterally mounted in the housing of the switch for providing a zero-play for both of said guide strip means.

13. A switch according to claim 12, characterized in that the first-mentioned leaf spring means is mounted in an immediate vicinity of the further guide strip means.

14. A switch according to claim 13, characterized in that said first lever means is provided with recess means adapted to be engaged by said second lever means.

15. A switch according to claim 14, characterized in that said pivot bearing means includes a bearing pin and a hole provided in said first lever means for accommodating said bearing pin, and in that a pivot axis of said bearing pin is disposed on a side of the first lever means opposite the operating element.

16. A switch according to claim 15, characterized in that a knife edge means integrally formed with a piston-like insert disposed in the housing of the switch is provided for tensioning said first lever means.

17. A switch according to claim 16, characterized in that said means for pivotally mounting said first lever means includes a further knife edge arranged at said operating element.

18. A switch according to claim 17, characterized in that both of said knife edges have an identical construction, said operating element includes a further piston-like insert upon which said further knife edge is arranged, and in that a sealing sleeve means is arranged at said operating element.

19. A switch according to claim 18, characterized in that said first mentioned leaf spring is a bimetallic spring.

20. A switch according to claim 19, characterized in that said first mentioned guide strip means is provided with a sloping surface for stopping a maximum extension of the first mentioned leaf spring means.

21. A switch according to claim 20, characterized in that the operating element is constructed as a piston means acted upon by said pressure fluid by way of an intermediary sealing sleeve or membrane.

22. A switch according to claim 3, characterized in that a further guide strip means is laterally guided in the housing of the switch, and in that said supporting surface means is provided on said further guide strip means.

23. A switch according to claim 22, characterized in that a cover plate is arranged over an upper edge of said further guide strip means, and in that the supporting surface means is inclined at a slight angle with respect to a plane extending through an upper edge of said further guide strip means and coinciding with a lower edge of the cover plate.

24. A switch according to claim 23, characterized in that the further guide strip means is displaceable in parallel to the first mentioned guide strip means, and in that a further slide means is provided for adjusting a position of the further guide strip means.

25. A switch according to claim 24, characterized in that further leaf spring means are laterally mounted in the housing of the switch for providing a zero-play for both of said guide strip means.

26. A switch according to claim 25, characterized in that the first-mentioned leaf spring means is mounted in an immediate vicinity of the further guide strip means.

27. A switch according to one of claims 2, 3, or 4, characterized in that said first lever means is provided with recess means adapted to be engaged by said second lever means.

28. A switch according to claim 27, characterized in that said pivot bearing means includes a bearing pin and a hole provided in said first lever means for accommodating said bearing pin, and in that a pivot axis of said bearing pin is disposed on a side of the first lever means opposite the operating element.

29. A switch according to one of claims 1, 2, 3, 4, 5, or 6, characterized in that a knife edge integrally formed with a stepped cylindrical insert disposed in the housing of the switch is provided for tensioning said first lever means.

30. A switch according to claim 29, characterized in that said means for pivotally mounting said first lever means includes a further knife edge arranged on a further stepped cylindrical element mounted in the housing.

31. A switch according to claim 30, characterized in that both of said knife edges have an identical construction, said operating element includes said further stepped cylindrical insert upon which said further knife edge is arranged, and in that a sealing sleeve means is arranged at said operating element.

32. A switch according to one of claims 1, 2, 3, 4, 5, or 6, characterized in that said first mentioned leaf spring is a bimetallic spring.

33. A switch according to one of claims 5 or 6, characterized in that said first mentioned guide strip means is provided with a sloping surface for stopping a maximum extension of the first mentioned leaf spring means.

34. A switch according to one of claims 1, 2, 3, 4, 5, or 6, characterized in that the operating element is constructed as a piston means acted upon by said pressure fluid by way of an intermediary sealing sleeve or membrane.

* * * * *